United States Patent [19]

Hiraoka et al.

[11] Patent Number: 4,559,062

[45] Date of Patent: Dec. 17, 1985

[54] APPARATUS FOR GASIFICATION OF SOLID CARBONACEOUS MATERIAL

[75] Inventors: Bunsho Hiraoka, Chiba; Tsutomu Tanaka; Koji Okane, both of Ibaraki, all of Japan

[73] Assignee: Sumitomo Metal Industries, Ltd., Osaka, Japan

[21] Appl. No.: 574,619

[22] Filed: Jan. 27, 1984

[51] Int. Cl.[4] ..... C10J 3/48

[52] U.S. Cl. ..... 48/92; 266/89; 266/239

[58] Field of Search ..... 48/92; 266/89, 239

[56] References Cited

U.S. PATENT DOCUMENTS

| | | | |
|---|---|---|---|
| 3,504,825 | 4/1970 | Diamond et al. | 266/239 |
| 4,062,657 | 12/1977 | Knuppel et al. | 48/92 |
| 4,394,006 | 7/1983 | Bedell | 266/239 |
| 4,459,137 | 7/1984 | Tanoue et al. | 48/92 |

*Primary Examiner*—Peter Kratz

*Attorney, Agent, or Firm*—Burns, Doane, Swecker & Mathis

[57] ABSTRACT

A gasification apparatus utilizing a molten metal bath is disclosed. The apparatus comprises:

a gasification chamber of the closed type, which is provided with a product gas recovery port and at least one top-blowing lance, and which maintains said molten metal bath;

a slag discharge chamber of the closed type, which is communicated with said gasification chamber;

a means for allowing a molten slag on the molten metal bath in said gasification chamber to flow into said slag discharge chamber;

a pressure controlling means for controlling the pressure of said slag discharge chamber so as to control the level of the molten slag in said slag discharge chamber;

a means for discharging the molten slag from said slag discharge chamber when the level of the molten slag in said slag discharge chamber reaches a predetermined height; and a slag collecting chamber of the closed type which collects the slag discharged out of said slag discharge chamber, said slag collecting chamber being in fluid communication with said slag discharge chamber so that said molten slag in said slag discharge chamber may flow into said slag collecting chamber.

2 Claims, 2 Drawing Figures

APPARATUS FOR GASIFICATION OF SOLID CARBONACEOUS MATERIAL

BACKGROUND OF THE INVENTION

This invention relates to an apparatus for gasification of a solid carbonaceous material, particularly to a gasification apparatus utilizing a molten metal bath, in which the heat required for gasifying the solid carbonaceous material is supplied through said molten metal bath. More particularly, this invention relates to a gasification apparatus utilizing a molten metal bath, from which the slag formed during gasification can be discharged in a continuous manner without tilting the furnace, in which gasification of a solid carbonaceous material such as coal, coke, etc. (hereunder sometimes collectively referred to as "coal") is carried out under pressure. The gasification apparatus utilizing a molten metal bath is hereinafter sometimes called a "molten metal coal gasification apparatus" or a "molten iron coal gasification apparatus" for convenience.

Many types of coal gasification processes and apparatuses using a molten metal bath have been proposed in the past.

One type is found in U.S. Pat. Nos. 4,388,084 and 4,389,246 in which pulverized coal, oxygen, and other auxiliary gasification agents are blown through a top-blowing lance onto the surface of a high temperature molten metal bath prepared in a furnace. This is hereinafter called a "top-blowing" system for convenience.

There are two types of furnaces used therefor; one is a tilting-type furnace similar to an oxygen converter used for steel making, i.e. a vertical type furnace; and the other one is a fixed type box furnace, i.e. a horizontal type furnace.

The gasification furnace of the top-blowing system has the following disadvantages:

(i) Since the slag formed is built-up within the furnace after a long-run operation, resulting in a decrease in gasification efficiency, a suitable means has to be provided to discharge the slag from the furnace. In case of the tilting-type furnace, the furnace is tilted for slag discharge, and during the discharge of slag the operation of gasification furnace has to be stopped. This means that it is impossible to continue the gasification for a long period of time.

(ii) Since the amount of slag increases during gasification, powdery coal to be blown into the molten metal bath is mostly caught by slag after the slag is built-up excessively and the coal thus caught is exhausted together with the gas from the molten metal bath before it is thoroughly subjected to gasification. This increases the flying loss of powdery coal, i.e. the loss of pulverized coal entrained by the product gas before it reaches the molten metal bath. In addition, this also increases the slag loss of coal, i.e. the loss of coal which is caught by the slag. Thus, the gasification efficiency as well as the heat content of the product gas decrease.

U.S. Pat. Nos. 3,533,739 and 3,526,478 propose another type of system of coal gasification in which pulverized coal is blown into a molten metal bath through a bottom-blowing nozzle provided in the bottom of the furnace. This system is hereinafter called a "bottom-blowing" system.

However, according to the system of the above U.S. patents, the lifetime of the bottom-blowing nozzle is very short. In addition, a decrease in gasification efficiency and heat content is inevitable with this bottom-blowing system due to an inevitable build-up of slag during gasification, although they are not so severely reduced as in the case of the top-blowing system. This is one of the difficulties which must be overcome in order to achieve a continuous and long-run gasification operation.

SUMMARY OF THE INVENTION

One of the objects of this invention is to provide a gasification apparatus which is free from the prior art disadvantages mentioned above.

Another object of this invention is to provide a solid carbonaceous material gasification apparatus with which a long, continuous operation can be achieved and an improved gasification efficiency as well as a constant supply of the product gas of a high calorie can be realized.

A further object of this invention is to provide a pressurized gasification apparatus in which a slag discharge chamber is provided inside or outside the gasification furnace, making it possible to continuously discharge the slag without tilting the furnace or stopping the operation of the furnace.

This invention resides in a gasification apparatus utilizing a molten metal bath, which comprises:

a gasification chamber of the closed type, which is provided with a product gas recovery port and at least one top-blowing lance, and which maintains said molten metal bath;

a slag discharge chamber of the closed type, which is communicated with said gasification chamber;

a means for allowing a molten slag on the molten metal bath in said gasification chamber to flow into said slag discharge chamber;

a pressure controlling means for controlling the pressure of said slag discharge chamber so as to control the level of the molten slag in said slag discharge chamber;

a means for discharging the molten slag from said slag discharge chamber when the level of the molten slag in said slag discharge chamber reaches a predetermined height; and a slag collecting chamber of the closed type which collects the slag discharged out of said slag discharge chamber, said slag collecting chamber being in fluid communication with said slag discharge chamber so that said molten slag may flow from said slag discharge chamber into said slag collecting chamber.

The gasification furnace may be of the vertical type or of the horizontal type. The gasification is carried out under pressure.

According to one embodiment of this invention, a pressurized gasification apparatus of the closed type utilizing a high temperature molten metal bath is provided, which comprises:

a gasification furnace of the closed type composed of a gasification chamber and a slag discharge chamber, said gasification chamber being of the closed type, being provided with a product gas recovery port and at least one top-blowing lance, and maintaining the high temperature molten metal bath, said slag discharge chamber being separated from said gasification chamber by a partition wall hung down from above, e.g., from the ceiling portion of said gasification furnace and being in fluid communication with said gasification chamber, said partition wall allowing a molten slag on said high temperature molten metal bath in said gasification chamber to flow into said slag discharge chamber;

a pressure controlling means for controlling the pressure of said slag discharge chamber so as to control the level of the molten slag in said slag discharge chamber, said pressure controlling means comprising a valving means composed of a pressurizing valve and a reducing valve for pressure control of said slag discharge chamber, a pressure measuring means for said slag discharge chamber and said gasification chamber, a means for detecting the difference in pressure between said two chambers, and a means for controlling pressure of said slag discharge chamber;

a means for discharging the molten slag from said slag discharge chamber when the level of the molten slag in said slag discharge chamber reaches a predetermined height; and a slag collecting chamber of the closed type which separates and collects the slag discharged out of said slag discharge chamber, said slag collecting chamber being in fluid communication with said slag discharge chamber so that the molten slag may flow into said slag collecting chamber.

According to another embodiment of this invention, a pressurized gasification apparatus of the closed type utilizing a high temperature molten metal bath is provided, which comprises:

a gasification furnace of the closed type composed of a gasification chamber, said gasification chamber being of the closed type, being provided with a product gas recovery port and at least one top-blowing lance, and maintaining said high temperature molten metal bath;

a slag discharge chamber provided outside of said gasification furnace, said slag discharge chamber being communicated with said gasification chamber and having a slope declined towards said gasification chamber;

a means for allowing a molten slag on the molten metal bath in said gasification chamber to flow into said slag discharge chamber;

a pressure controlling means for controlling the pressure of said slag discharge chamber so as to control the level of the molten slag in said slag discharge chamber, said pressure controlling means comprising a valving means composed of a pressurizing valve and a reducing valve for pressure control of said slag discharge chamber, a pressure measuring means for said slag discharge chamber and said gasification chamber, a means for detecting the difference in pressure between said two chambers, and a means for controlling pressure of said slag discharge chamber;

a means for discharging the molten slag from said slag discharge chamber when the level of the molten slag in said slag discharge chamber reaches a predetermined height; and a slag collecting chamber of the closed type which separates and collects the slag discharged out of said slag discharge chamber, said slag collecting chamber being in fluid communication with said slag discharge chamber so that the molten slag may flow into said slag collecting chamber.

DETAILED DESCRIPTION OF THE PREFERRED EMBODIMENTS

According to one of preferred embodiments of this invention, a pressurized gasification apparatus of the closed type is divided into a gasification chamber and a slag discharge chamber by means of a partition wall hung down from the ceiling portion of the furnace. Both the chambers are in fluid communication with each other so that the molten slag in said gasification chamber may flow into said slag discharge chamber.

A pressure controlling apparatus is also provided which comprises pressurizing and depressurizing valving for control of the pressure of the slag discharge chamber, a means for measuring the pressure each of said gasification chamber and said slag discharge chamber, a means for detecting the difference in pressure of the two chambers, and means for controlling said pressurizing and depressurizing valving. By means of said pressure controlling apparatus, the pressure of said slag discharge chamber is reduced to raise the level of slag within the furnace until the level of the slag in this chamber is high enough for it to be discharged.

In addition, according to this invention, in order to continuously discharge the slag formed during gasification in a high pressure gasification furnace of the closed type, the slag discharge chamber is provided and a slag collecting chamber of the closed type is also provided outside the furnace, the slag collecting chamber being also in fluid communication with said slag discharge chamber so that a molten slag on the molten metal bath in the gasification chamber may freely flow into the slag collecting chamber through a discharge port, i.e., a means for discharging the molten slag from said slag discharge chamber when the level of the molten slag in said slag discharge chamber reaches a predetermined height.

Figure 1:
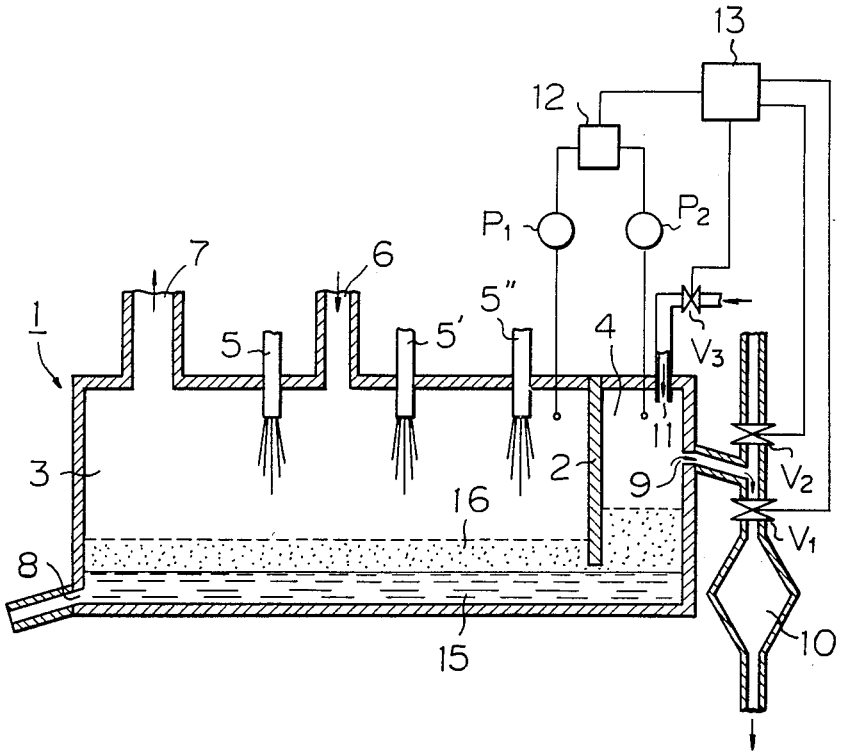
FIG. 1 is a schematic view in section of a gasification apparatus of the horizontal type which is one of embodiments of this invention.

The embodiments of this invention mentioned above will be further described in conjunction with FIG. 1 of the drawings attached hereto.

FIG. 1 shows one example of this invention in which a slag discharge chamber is provided within a gasification furnace of the horizontal type. A box-shaped gasification furnace 1 is divided into a gasification chamber 3 and a slag discharge chamber 4 by means of a partition wall 2 suspended from the ceiling portion of the furnace. At the ceiling portion of the gasification chamber non-immersing-type multihole lances 5, 5', 5'' are provided, through each of which coal, oxygen, and other auxiliary agents (such as steam) can be blown into the molten metal bath. There is also provided a cast iron-charging port 6, which also serves as an inlet port for auxiliary raw materials. A product gas recovery port 7 is also provided. Reference numeral 8 indicates a tapping port for molten steel.

The partition wall 2 is cooled with water-cooling piping or air-cooling piping, etc. embedded therein so that the wall may resist mechanical stress (caused by the difference in pressure of the gasification chamber and the slag discharge chamber) and corrosive attack by slag.

The slag built up in the slag discharge chamber 4 is passed through a discharge port 9 provided at a suitable level into a slag collecting chamber 10. It is preferable to design the slag discharge port 9 to decline towards the outside of the furnace so as to promote the downwards flow of the slag to the slag collecting chamber 10.

The reference FIGS. $V_1$, $V_2$ indicate pressure reducing valves for use in control of the pressure of slag discharge chamber 4, 11 indicates an inlet of a high pressure gas for use in the control of the pressure of the slag discharge chamber 4, $V_3$ is a high pressure valve therefor, and $P_1$, $P_2$ are means for measuring the pressures of the gasification chamber 3 and the slag discharge chamber 4, respectively. Reference numeral 12 indicates a detector of the difference in pressure of the two chambers, 13 is a pressure controlling apparatus which actuates said pressure reducing valve $V_1$, $V_2$ and high pressure valve $V_3$. Namely, as is apparent from the drawing, the pressure-controlling mechanism of the slag discharge chamber 4 comprises pressure reducing valves $V_1$, $V_2$, a high pressure gas inlet 11, a high pressure valve $V_3$, pressure-measuring means $P_1$, $P_2$, a pressure difference detector 12, and a pressure controlling apparatus 13.

In carrying out gasification of coal using the gasification furnace shown in FIG. 1, molten iron at a temperature of about 1500° C. is maintained within the gasification furnace 1. Into the thus prepared molten iron bath, coal, oxygen, and other auxiliary agents such as steam are blown through the non-immersing-type multihole lances 5, 5', 5''. At the same time, auxiliary raw materials such as a slag adjusting agent are added to the melt through a cast iron-charging port 6.

A high pressure gas formed in the gasification chamber 3 is recovered through a product gas recovery port 7. On the other hand, the slag formed during gasification is moved through the area between the furnace bottom and the lower end of the partition wall 2 into the slag discharge chamber 4. The difference in pressure of the gasification chamber 3 and the slag discharge chamber 4 is suitably adjusted by means of the pressure controlling apparatus 13 such that the level of the molten slag is not as high as the level of the discharge port 9. As the gasification proceeds, the slag 16 is built up on a molten metal bath 15 within the furnace. When it is necessary to discharge the slag from the furnace, the level of the slag within the slag discharge chamber 4 is raised by reducing the pressure of the chamber 4 by means of pressure reducing valves $V_1$, $V_2$ until the slag level in the chamber 4 goes up beyond the level of the port 9. The thus discharged slag is passed to the slag collecting chamber 10. After a given amount of slag is discharged out of the furnace 1, the level of the slag is lowered by increasing the pressure of the slag discharge chamber. The pressure is increased by supplying a high pressure gas such as high pressure nitrogen gas into the chamber 4 through a high pressure gas inlet 11 by means of the high pressure valve $V_3$.

Then the pressures of the gasification chamber 3 and the slag discharge chamber 4 are measured by the pressure-measuring means $P_1$, $P_2$. The difference in pressure between the two chambers is determined by means of the detector 12. On the basis of the thus determined pressure difference, the levels of the slag in the gasification chamber 3 and the slag discharge chamber 4 are controlled. When the level of slag within the slag discharge chamber 4 is kept at a level higher than a predetermined one, e.g., the level of the discharge port 9, it is possible to continue the discharge of slag during gasification. When the slag is maintained for a while in the slag discharge chamber 4, the molten iron entrained by the slag may be separated therefrom into the molten iron bath due to the difference in density of the slag and molten iron.

Another preferred embodiment of this invention will be described in conjunction with FIG. 2, in which the slag discharge chamber is provided outside the furnace.

Figure 2:
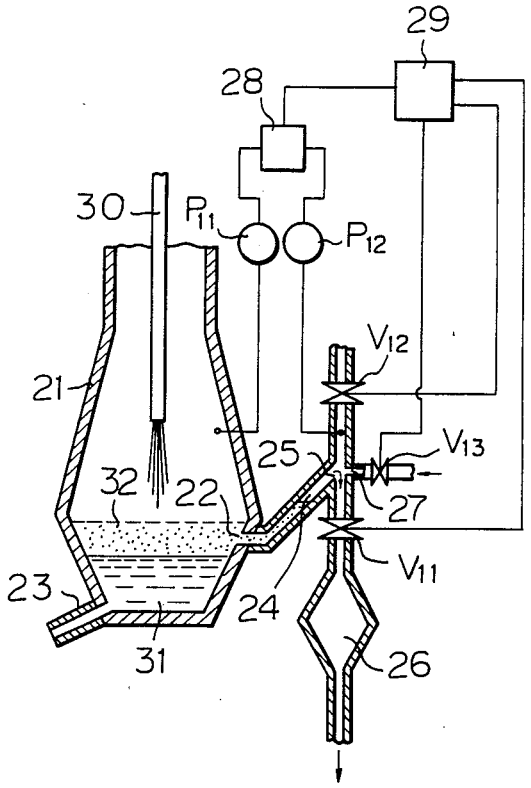
FIG. 2 is a schematic view in section of a gasification apparatus of the vertical type which is another embodiment of this invention.

As is shown in FIG. 2, a gasification furnace 21 of the vertical type which constitutes a gasification chamber comprises a slag discharge path 22 in the wall portion thereof and a steel tapping port 23 on the bottom thereof. Along the slag discharge path 22, a slag discharge chamber 24 having an inclined wall is provided in fluid communication with the furnace 21. Between a slag discharge port 25 and a slag collecting chamber 26, reducing valves $V_{11}$, $V_{12}$, a high pressure gas blowing nozzle 27, and a high pressure valve $V_{13}$ are provided so as to control the pressure of the slag discharge chamber 24. $P_{11}$ and $P_{12}$ indicate pressure measuring means, 28 indicates a means for detecting the difference in pressure of the gasification chamber 21 and the slag discharge chamber 24, and 29 is a pressure controlling means.

Through a multihole top-blowing lance 30 of the non-immersing-type, pulverized coal, oxygen, and an auxiliary agent such as steam are blown into the molten metal bath.

The slag discharge chamber 24 is inclined towards the outside of the furnace. Thus, it is possible to control the slag level by controlling the pressure in the same manner as in the case of FIG. 1. It is also possible to carry out a continuous discharge of the slag without tilting the furnace. Molten iron entrained by the slag is separated from the slag in the upwardly inclined slag discharge chamber and is returned to the molten bath. It is preferable that the slag path be also upwardly inclined.

In carrying out gasification with the apparatus shown in FIG. 2, coal, oxygen, and steam, etc. are blown through the top-blowing lance 30 into the molten metal bath 31 in the same manner as in FIG. 1. The product gas is recovered through a gas recovery port (not shown). When the slag 32 has built up to a certain level, it is necessary to discharge the slag. At this point, the pressure of the slag discharge chamber 24 is reduced by means of reducing valves $V_{11}$, $V_{12}$ through a pressure controlling apparatus 29 so that the liquid level of molten slag is raised. That is, the liquid level of the molten slag of the slag discharge chamber 24 is increased until the slag is discharged through the slag discharging port 25. After a given amount of slag has flown out of the furnace, the pressure of the slag discharge chamber is raised by supplying a high pressure gas such as nitrogen gas through a high pressure gas blowing nozzle 27 so that the pressure of the slag discharge chamber 24 is raised to a predetermined level sufficient to lower the liquid level of the slag. Then the pressure each of the gasification chamber 21 and the slag discharge chamber 24 are determined by means of the pressure measuring means $P_{11}$, $P_{12}$, respectively, and then the difference in pressure of the two chambers is determined by means of the pressure difference detecting means 28, and the difference is then controlled by means of the pressure controlling means 29 so as to keep the liquid levels of the two chambers at predetermined levels. When the liquid level of the slag discharge chamber 24 is kept at the same level as that of the slag discharge port 25, a continuous discharge of slag is possible. In addition, since the slag discharge chamber 24 is angled downwards toward the gasification chamber 21, the molten iron entrained by the slag is separated from the slag and returned to the molten metal bath during residence in the slag discharge chamber due to the difference in specific gravity of the slag and molten iron.

Thus, according to this invention, it is possible to carry out a continuous discharge of slag during operation without tilting the furnace merely by controlling the pressures of the gasification chamber and the slag discharge chamber. Therefore, it is possible to carry out coal gasification for long periods. In addition, since it is possible to keep the liquid slag level at the same level during operation, the fly loss of the input coal and the slag loss of coal which is caught by slag before it reaches the molten metal bath are markedly reduced, resulting in a remarkable increase in gasification efficiency and heat content of the product gas. In addition, most sulfur contained in the coal which is blown into the molten iron bath is caught by slag during gasification, and so the product gas is substantially free of such contaminant components.

Furthermore, according to this invention, the gasification apparatus is of the closed type, so the liquid level of the molten slag may be controlled by adjusting the pressure of each of the chambers, and since the product gas is pressurized, it need not be pressurized prior to use.

This invention will be described in conjunction with some working examples thereof, which are presented merely for illustrative purposes and which do not restrict this invention in any way.

EXAMPLE 1

40 tons of molten iron having a composition of 3% of C, 1% of S, 0.1% of P at 1500° C. were charged into a coal gasification furnace having the same structure as that shown in FIG. 1 with the following dimensions. Pulverized coal, 80% or more of which was minus 200 mesh and had the analytical composition shown in Table 1, was introduced to the furnace at a rate of 6.7 tons/hr. to effect gasification.

(1) Furnace:
Effective Length: 5 m
Effective Width : 3 m
Effective Height: 3 m
(2) Gasification Chamber:
Effective Volume: 38 $m^3$
(3) Slag Discharge Chamber:
Effective Volume: 6 $m^3$
(4) Distance between the Lower End of Partition Wall and Furnace Bottom: 0.7 m
(5) Height of Slag Discharge Port from the Furnace Bottom: 1.1 m

TABLE 1

| C | H | N | O | S | Ash | (weight %) Moisture |
|---|---|---|---|---|---|---|
| 84.3 | 5.2 | 1.8 | 7.9 | 0.8 | 8.0 | 2.2 |

Oxygen gas used as a gasification agent was blown at the rate of 4000 $Nm^3$/hr, and steam was supplied as an auxiliary agent at 1000 kg/hr. The pressures of the gasification chamber and the slag discharge chamber were kept at 3 kg/$cm^2$ and 2.8 kg/$cm^2$, respectively. The pressure of this slag discharge chamber was reduced to 2.4–2.0 kg/$cm^2$ while discharging the slag. The high pressure gas for use in controlling the pressure of the slag discharge chamber was 15 $m^3$ of nitrogen gas at a pressure of 9 kg/$cm^2$.

After continuous running for 100 days under the above-mentioned conditions, the average composition of the product gas was determined. The results are shown in Table 2 below. As is apparent therefrom, the product gas was clean and was substantially free of contaminant components. The average volume of the product gas was 15000 $Nm^3$/hr. The recovery of carbon in coal, i.e. the ratio of carbon content of the product gas to that in the coal supplied was as high as 99%. The composition of the slag formed during gasification is shown in Table 3. The basicity thereof was 1.2 and the production was 1100 kg/hr on the average

TABLE 2

| CO | $CO_2$ | $H_2$ | $N_2$ | $O_2$ | $CH_4$ | (Volume %) $H_2S$ + COS |
|---|---|---|---|---|---|---|
| 60 | 4 | 30 | 6 | 0 | 0 | 300 (ppm), max. |

TABLE 3

| $SiO_2$ | $Al_2O_3$ | CaO | MgO | $TiO_2$ | $P_2O_5$ | (Weight %) FeO | S |
|---|---|---|---|---|---|---|---|
| 25 | 7 | 25 | 38 | 0 | 0 | 3.0 | 0.2 |

EXAMPLE 2

40 tons of molten iron having the same composition as that used in Example 1 was charged to a coal gasification furnace having the same structure as that shown in FIG. 2 with the following dimensions. Pulverized coal having the same chemical composition and paticle size as that used in Example 1 as introduced to the furnace at a rate of 6.7 tons/hr to effect gasification thereof.

(1) Furnace:
Maximum Inner Diameter: 4 m
Effective Furnace Height: 7 m
(2) Slag Discharge Chamber:
Effective Inner Volume: 0.1 $m^3$
Inclination Angle: 30°
(3) Height of the Slag Discharge Port from the Furnace Bottom: 0.5 m After continuous running for 100 days under the same conditions as in Example 1, the average composition of the gas product gas was determined. The results of determination are shown in Table 4 below. As is apparent therefrom, in this case, too, the product gas was clean and was substantially free of contaminant components. The average gas volume was 15000 $Nm^3$/hr. The recovery of carbon in coal was as high as 99%. The composition of the slag formed during gasification is shown in Table 5. The basicity was 1.2 and the production was 1100 kg/hr on the average.

TABLE 4

| CO | $CO_2$ | $H_2$ | $N_2$ | $O_2$ | $CH_4$ | (Volume %) $H_2S$ + COS |
|---|---|---|---|---|---|---|
| 60 | 4 | 30 | 6 | 0 | 0 | 300 (ppm), max. |

TABLE 5

| $SiO_2$ | $Al_2O_3$ | CaO | MgO | $TiO_2$ | $P_2O_5$ | (Weight %) FeO | S |
|---|---|---|---|---|---|---|---|
| 25 | 7 | 25 | 38 | 0 | 0 | 3.0 | 0.2 |

As is apparent to those skilled in the art, according to the apparatus of this invention, it is possible to carry out a continuous gasification for a long period of time without stopping the operation even when the slag is being discharged, resulting in a remarkably increased gasification efficiency. Thus, this invention is very much advantageous from a practical view.

Although this invention has been described with respect to preferred embodiments, it is to be understood that variations and modifications may be employed without departing from the concept of this invention as defined in the following claims.

What is claimed is:

1. A pressurized gasification apparatus of the closed type utilizing a high temperature molten metal bath, which comprises:

a gasification furnace of the closed type composed of a gasification chamber and a slag discharge chamber;

said gasification chamber being of the closed type, being provided with a product gas recovery port and at least one top-blowing lance, and maintaining said high temperature molten metal bath, said slag discharge chamber being separated from said gasification chamber by a partition wall hung down from above and being in fluid communication with said gasification chamber, said partition wall allowing a molten slag on said high temperature molten metal bath in said gasification chamber to flow into said slag discharge chamber;

a pressure controlling means for controlling the pressure of said slag discharge chamber so as to control the level of the molten slag in said slag discharge chamber, said pressure controlling means comprising a valving means composed of a pressurizing valve and a reducing valve for pressure control of said slag discharge chamber, a pressure measuring means for said slag discharge chamber and said gasification chamber, a means for detecting the difference in pressure between said two chambers, and a means for controlling the pressure of said slag discharge chamber;

a means for discharging the molten slag from said slag discharge chamber when the level of the molten slag in said slag discharge chamber reaches a predetermined height; and a slag collecting chamber of the closed type which separates and collects the slag discharged out of said slag discharge chamber, said slag collecting chamber being in fluid communication with said slag discharge chamber so that the molten slag in said slag discharge chamber may flow into said slag collecting chamber.

2. A pressurized gasification apparatus of the closed type utilizing a high temperature molten metal bath, which comprises:

a gasification furnace of the closed type composed of a gasification chamber, said gasification chamber being of the closed type, being provided with a product gas recovery port and at least one top-blowing lance, and maintaining said high temperature molten metal bath;

a slag discharge chamber provided outside of said gasification furnace, said slag discharge chamber being communicated with said gasification chamber and having a slope declined towards said gasification chamber;

a means for allowing a molten slag on the molten metal bath in said gasification chamber to flow into said slag discharge chamber;

a pressure controlling means for controlling the pressure of said slag discharge chamber so as to control the level of the molten slag in said slag discharge chamber, said pressure controlling means comprising a valving means composed of a pressurizing valve and a reducing valve for pressure control of said slag discharge chamber, a pressure measuring means for said slag discharge chamber and said gasification chamber, a means for detecting the difference in pressure between said two chambers, and a means for controlling pressure of said slag discharge chamber;

a means for discharging the molten slag from said slag discharge chamber when the level of the molten slag in said slag discharge chamber reaches a predetermined height; and a slag collecting chamber of the closed type which separates and collects the slag discharged out of said slag discharge chamber, said slag collecting chamber being in fluid communication with said slag discharge chamber so that the molten slag in said slag discharge chamber may flow into said slag collecting chamber.

* * * * *